US009605228B2

(12) United States Patent
Mosleh et al.

(10) Patent No.: US 9,605,228 B2
(45) Date of Patent: Mar. 28, 2017

(54) METHODS AND COMPOSITIONS FOR REDUCING WEAR OF SURFACES IN CONTACT WITH ONE ANOTHER

(75) Inventors: Mohsen Mosleh, Bethesda, MD (US); John H. Belk, Creve Coeur, MO (US)

(73) Assignee: The Boeing Company, Chicago, IL (US)

( * ) Notice: Subject to any disclaimer, the term of this patent is extended or adjusted under 35 U.S.C. 154(b) by 1163 days.

(21) Appl. No.: 12/576,643

(22) Filed: Oct. 9, 2009

(65) Prior Publication Data

US 2010/0255203 A1 Oct. 7, 2010

Related U.S. Application Data

(60) Provisional application No. 61/166,849, filed on Apr. 6, 2009.

(51) Int. Cl.

| | |
|---|---|
| ***B05D 3/12*** | (2006.01) |
| ***C10M 103/00*** | (2006.01) |
| ***C10M 103/06*** | (2006.01) |
| ***C10M 125/20*** | (2006.01) |
| ***C10M 125/22*** | (2006.01) |

(52) U.S. Cl.

CPC ..... *C10M 103/00* (2013.01); *C10M 103/06* (2013.01); *C10M 125/20* (2013.01); *C10M 125/22* (2013.01); *C10M 2201/061* (2013.01); *C10M 2201/066* (2013.01); *C10N 2210/06* (2013.01); *C10N 2220/082* (2013.01); *C10N 2230/06* (2013.01); *C10N 2240/401* (2013.01); *C10N 2250/08* (2013.01); *C10N 2250/12* (2013.01); *C10N 2270/00* (2013.01)

(58) Field of Classification Search

CPC ..... C10M 103/00; C10M 125/20
USPC ..... 427/346
See application file for complete search history.

(56) References Cited

U.S. PATENT DOCUMENTS

2009/0054275 A1 2/2009 Billiet et al.

FOREIGN PATENT DOCUMENTS

| | | | | |
|---|---|---|---|---|
| JP | H07118683 A | | 5/1995 | |
| JP | 10130678 | * | 5/1998 | ..... C10M 125/26 |
| WO | 2007082299 A2 | | 7/2007 | |

OTHER PUBLICATIONS

International Search Report and Written Opinion of PCT/YS2010/029981; Aug. 11, 2010; 16 pages.

Rapoport, L. et al; Fullerene-like WS2 Nanoparticles: Superior Lubricants for Harsh Conditions; Advanced Materials 2003; vol. 15 No. 7-8; Apr. 17, 2003; pp. 651-655.

(Continued)

*Primary Examiner* — Alexander Weddle
(74) *Attorney, Agent, or Firm* — Armstrong Teasdale LLP

(57) ABSTRACT

A method for reducing wear between two surfaces in sliding contact with one another includes introducing nanoparticles between the two surfaces in an amount and having a composition that results in shear lines being generated within at least one agglomerated wear particle that is generated between the two surfaces as a result of the sliding contact, and subjecting the agglomerated wear particles to at least one load, using at least one of the two surfaces, such that the agglomerated wear particles disassemble along the shear lines into multiple smaller wear particles.

15 Claims, 6 Drawing Sheets

(56) References Cited

OTHER PUBLICATIONS

Cizaire, C. et al.; Mechanisms of Ultra-Low Friction by Hollow Inorganic Fullerene-like MoS2 Nanoparticles; Surface and Coatings technology; vol. 160 No. 2-3; 2002-10-22; pp. 282-250.
Shen, B. et al.; Performance of Novel MoS2 Nanoparticles based Grinding Fluids in Minimum Quantity Lubrication Grinding; Transactions of the North American Manufacturing Research Institution of SME; vol. 36; May 1, 2008; pp. 357-364.
J. Bech, N. Bay (1), M. Eriksen, A Study of Mechanisms of Liquid Lubrication in Metal Forming, Annals of the CIRP , 1998, pp. 221-226, vol. 4, Department of Manufacturing Engineering, Technical University of Denmark, Lyngby, Denmark.
Teisuke Sato, Tatsuo Besshi, Anti-Galling Evaluation in Aluminum Sheet Forming, Journal of Materials Processing Technology, 1998, pp. 185-191, vol. 83, Elsevier, Japan.
A. L. Black, R. W. Dunster and J. V. Sanders, Comparative Study of Surface Deposits and Behaviour of MoS2 Particles and Molybdenum Dialkyl-Dithio-Phosphate, Wear, 1969, pp. 119-132, vol. 13, Elsevier Sequoia S.A., Lausanne, Netherlands.
J. Gänsheimer and R. Holinski, A Study of Solid Lubricants in Oils and Greases Under Boundary Conditions, Wear, 1972, pp. 439-449, vol. 19, Elsevier Sequoia S.A., Lausanne, Nertherlands.
J. Gansheimer and R. Holinski, Molybdenum Disulfide in Oils and Greases Under Boundary Conditions, Journal of Lubrication Technology, 1973, pp. 242-248, Transactions of the ASME, USA.
T. Hisakado, T. Tsukizoe and H. Yoshikawa, Lubrication Mechanism of Solid Lubricants in Oils, Journal of Lubrication Technology, 1983, pp. 245-253, vol. 105, ASME, USA.
L. Rapoport, Y. Feldman, M. Homyonfer, H. Cohen, J. Sloan, J. L. Hutchison and R. Tenne, Inorganic Fullerence-Like Material as Additives to Lubricants: Structure-Function Relationship, Wear, 1999, pp. 975-982, vol. 225-229, Elsevier Science S.A., UK.
A. Hernández Battez, R. González, J. L. Viesca, J. E. Fernández, J. M. Díaz, A. Machado, R. Chou and J. Riba, CuO, ZrO2, and ZnO Nanoparticles as Antiwear Additive in Oil Lubricants, Wear, ScienceDirect, 2007, pp. 422-428, vol. 265, Elsevier, Netherlands.
Z. S. Hu and J. X. Dong, Study on Antiwear and Reducing Friction Additive of Nanometer Titanium Borate, Wear, 1998, p. 87-91, vol. 216, Elsevier, UK.
Z. S. Hu, J. X. Dong and G. X. Chen, Study on Antiwear and Reducing Friction Additive of Nanometer Ferric Oxide, Tribology International, 1998, pp. 355-360, vol. 31, No. 7, Elsevier Sciences, UK.
Y. Y. Wu, W. C. Tsui and T. C. Liu, Experimental Analysis of Tribological Properties of Lubricating Oils with Nanoparticle Additives, Wear, ScienceDirect, 2007, pp. 819-825, vol. 262, Elsevier, Netherlands.
F. Chiñas-Castillo and H. A. Spikes, Mechanism of Action of Colloidal Solid Dispersions, Journal of Tribology, Transaction of the ASME, 2003, pp. 552-557, vol. 125, ASME, USA.
L. Cizaire, B. Vacher, T. Le Mogne, J. M. Martin, L. Rapoport, A. Margolin and R. Tenne, Mechanisms of Ultr-Low Friction by Hollow Inorganic Fullerene-Like MoS2 Nanoparticles, Surface & Coatings Technology, 2002, pp. 282-287, vol. 160, Elsevier Science B.V., Netherlands.
L. Rapoport, V. Leshchinsky, I. Lapsker, Yu. Volovik, O. Nepomnyashchy, M. Lvovsky, R. Popovitz-Biro, Y. Feldman and R. Tenne, Tribological Properties of WS2 Nanoparticles Under Mixed Lubrication, Wear, ScienceDirect, 2003, pp. 785-793, vol. 255, Elsevier Science B. V., Netherlands.
S. Türker Oktay and Nam P. Suh, Wear Debris Formation and Agglomeration, Journal of Tribology, 1992, pp. 379-393, vol. 114, ASME, USA.
J. Xu and K. Kato, The Effect of Water Vapor on the Agglomeration of Wear Particles of Ceramics, Wear, 1997, pp. 165-171, vol. 202, Elsevier Sciences S.A., Netherlands.
M. Mosleh, N. Saka, and N. P. Suh, A Mechanism of High Friction in Dry Sliding Bearings, Wear, 2002, pp. 1-8, vol. 8739, Elsevier Science B. V., Netherlands.
JPO Office Action for related application 2014-180206 dated Sep. 29, 2015; 4 pp.
EPO Examination Report for related application 10723440.3 dated Apr. 23, 2015, 4 pp.
JPO Decision of Rejection for related application 2014-180206 issued Mar. 15, 2016; 4 pp.

* cited by examiner

METHODS AND COMPOSITIONS FOR REDUCING WEAR OF SURFACES IN CONTACT WITH ONE ANOTHER

CROSS-REFERENCE TO RELATED APPLICATIONS

This application claims the benefit of Provisional Patent Application Ser. No. 61/166,849, filed Apr. 6, 2009, and entitled "Modification of Sheet Metal Forming Fluids With Dispersed Nanoparticles for Improved Lubrication", the disclosure of which is hereby incorporated by reference in its entirety for all purposes.

BACKGROUND

The field relates generally to machining and other fabrication and manufacturing processes, and more specifically, to methods and apparatus for reducing wear of surfaces in contact with relative motion with respect to one another, including, for example, sliding, rolling, and other forms of motion.

Many processes are known where friction from a first metal device engaging a second metal device produces heat, wear, deformation, and surface blemishes. Sometimes, the two devices may be different metals, one of the devices may not be a metal, or neither of the devices may be metal, such as ceramic. One simple example is the drilling of holes into a component using a bit. In many of these applications, the wear resulting from the sliding engagement between the two devices eventually results in reduced quality, increased heat generation and a corresponding reduction in process speed or reduced energy efficiency. Other detrimental results from the above described sliding engagement between two surfaces are also known. Types of wear include erosion, cavitation, rolling, sliding and rolling, and impact (large body, small particle, and liquid). Types of contact between surfaces can include sliding abrasion ("two body"), rolling abrasion ("three body") and scratching.

Reducing wear in such applications is desired since it allows a tool or a die to be used longer simply because it lasts longer. In physical terms, reducing wear translates into reducing the rate at which material from one of the devices is removed from its acting surface. In one practical example, reducing wear allows a drill bit to drill more holes before it needs to be replaced. The drill bit can be used longer because the surface quality, including for example a smoothness associated with the surface, is less adversely affected.

Current implementations within such processes do not necessarily reduce wear. Instead, such implementations attempt to reduce friction. Solutions for reducing friction include the adding of lubricants, such as oils, greases, and solid lubricants, for example, molybdenum disulfide ($MoS_2$), to processes; and dry lubricants such as coatings and powders. Other solutions include custom coatings applied to the surface where engagement is expected to occur.

Various custom coatings can be used to protect surfaces, such as coating the cutting surfaces of drill bits. However, once the drill bit is worn out (in some applications this can occur in as few as three holes, at $75/bit, for some composite material drilling processes), it must be reground. Regrinding removes the coating so the bit must also go through the coating processes again before it can once again be utilized in the process.

While the accumulation and agglomeration of wear particles at the sliding interface and their adverse effects on friction and wear are known, the means for breaking down wear agglomerates has not been well considered. One beneficial method is to develop a method or system to reduce particle size that can accumulate between sliding surfaces, especially in applications with substantial forces between the surfaces. Particle size reduction can result in greater direct contact between the surfaces. Such a method and system would improve efficiency and cost effectiveness of many industrial applications such as drilling and grinding.

BRIEF DESCRIPTION

In one aspect, a method for reducing wear between two surfaces in sliding contact with one another is provided. The method includes introducing nanoparticles between the two surfaces, in a quantity and composition that results in shear lines being generated within at least one agglomerated wear particle. These agglomerated wear particles are generated between the two surfaces as a result of the sliding contact between the surfaces. By subjecting the agglomerated wear particles to at least one load, using at least one of the two surfaces, such that the agglomerated wear particles disassemble along the shear lines into multiple smaller wear particles, allowing for protected contact between the two surfaces.

In another aspect, a method for reducing wear between two surfaces in sliding contact with one another is provided. The method includes using nanoparticles to destabilize agglomerated wear particles that build up between the two surfaces as a result of the sliding contact, and causing the destabilized, agglomerated wear particles to break down into smaller pieces, allowing for protected contact between the two surfaces.

The features, functions, and advantages that have been discussed can be achieved independently in various embodiments, of the present invention or may be combined in yet other embodiments further details of which can be seen with reference to the following description and drawings.

DETAILED DESCRIPTION

The embodiments described herein relate to methods and compositions for reducing mass loss of either or of both surfaces when those two surfaces are in sliding contact with one another. Generally, the surfaces are metal, such as a drill bit and a component on which the drill bit is operating. However, the embodiments are certainly applicable in applications where one or both of the surfaces are not metal. The reduction in the loss of mass occurs through the destabilization of agglomerated wear particles that are generated during the sliding contact, or rubbing, between the two items or surfaces. In other embodiments, the agglomerated wear particles may be referred to as a "solid film" which may have a relatively higher aspect ratio that is different from substantially spherical.

Figure 1:
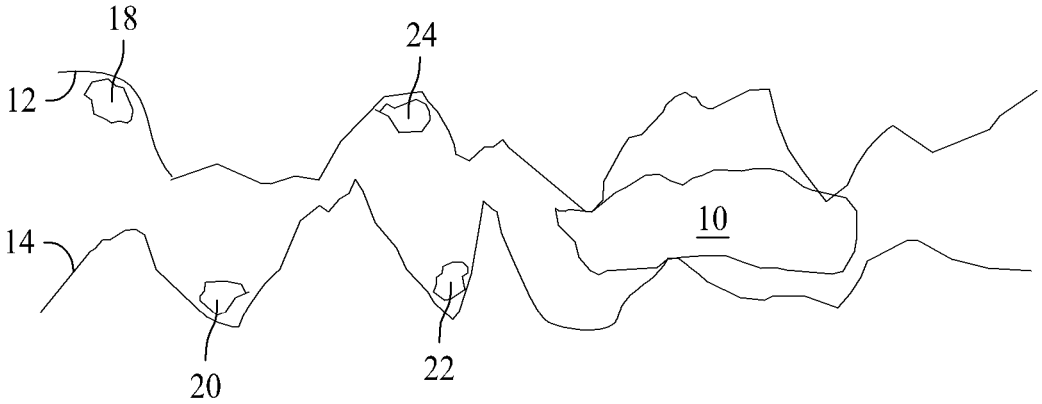
FIG. 1 is an illustration of an agglomerated wear particle between two surfaces that are intended to be in sliding contact with one another.

FIG. 1 is a prior art illustration of an agglomerated wear particle 10 between two surfaces 12 and 14 that are in sliding contact with one another. FIG. 1 is a microscopic view which illustrates that surfaces 12 and 14 are imperfect, exhibiting a series of peaks and valleys. However, surfaces 12 and 14 are illustrative of typical surfaces which, while possibly appearing smooth to the naked eye and possibly feeling smooth to the touch, actually can have fairly large asperities at low magnification.

As is known in the art, worn debris removed from one or both rubbing surfaces 12 and 14 tend to aggregate under the contact pressure to create the agglomerated wear particle 10, which can be abrasive especially to the softer of the two surfaces 12 and 14. This agglomerated wear particle 10 is less effective as an abrasive as long as it remains smaller than some characteristic dimension of the surface finish. As wear particle 10 increases in size, the interaction between the two surfaces 12 and 14 is diminished due to the buildup in size of wear particle 10. More specifically, surfaces 12 and 14 stop interacting directly with one another because the wear particle 10, and other particles like wear particle 10, increase in size. The wear particles, such as wear particle 10, are abrasive because they are work hardened as a result of plastic deformation and affect both of the opposing surfaces 12 and 14. Essentially, wear particle 10 is operating on both surfaces 12 and 14. In the drilling example, when the wear particle 10 is of sufficient size, it is performing the material removal, based on a pressure applied by the bit to the wear particle 10, instead of the bit acting directly on a surface. However, this interaction is not nearly as efficient as a direct interaction between the surfaces 12 and 14. Further, as surface 12 represents a cutting tool designed to operate on surface 14, the abrasion received on surface 12 from wear particle 10 acts to reduce the operating life of the cutting tool.

Wear particles 18, 20, 22, and 24, at the point in time shown in FIG. 1, are smaller than wear particle 10. Such wear particles tend to congregate within the surfaces imperfections as shown in the figure. With continued interaction between surfaces 12 and 14 and wear particle 10, however, wear particles 18, 20, 22, and 24 may also increase in size to the point where they affect interaction between surfaces 12 and 14 and further add to the problems causing by wear particles the size of wear particle 10. It is apparent that the higher percentage of time each wear particle exists as one of these smaller particles, translates into less wear on the two surfaces 12 and 14. In current applications, wear particles 18, 20, 22, and 24 may became agglomerated on their own or with wear particle 10, adding to the problems it causes, which are described above.

Generally, to reduce wear on surfaces 12 and 14, the wear particles should remain to remain small enough to "hide" in the surface roughness, pits, and grooves of the rubbing surfaces 12 and 14, as do the smaller wear particles 18, 20, 22, and 24. Unfortunately, with continued interaction between surfaces 12 and 14, the agglomerated wear particle 10 will continue to increase in size up to a stable large size determined by material properties and the conditions of contact between the two surfaces 12 and 14. As described above, additional wear action between the surfaces 12 and 14 will result.

The following paragraphs describe how to convert the agglomerated wear particle 10, which is created in the process of rubbing surfaces 12 and 14 together, into a particle that is apt to fall apart or disassemble into smaller particles under the normal and frictional loads typically experienced in such operations. Such a wear particle is created by essentially causing sheer planes or fault lines to be added within wear particles as they agglomerate.

Generally, when thinking of processes that use lubrication, those processes are thought of as being low in friction and also thought of in terms of the part being produced. More specifically, it is generally considered that the part being produced is invariably made from the softer of the two metals in the process, and that the harder metal works the softer metal. As a result, most solutions deal with lubrication and nanoparticles within the lubrication material being used to improve the processing of the part being made.

In contrast, the following embodiments relate more to the tooling that makes such parts, through destabilization, for example through shearing, of the agglomerated wear particle to reduce a rate of wear at both surfaces. These embodiments take advantage of the latest understanding of the interaction at the point of contact between surfaces of the two materials in contact. More specifically, the embodiments describe how to destabilize agglomerated wear particles, which in turn can be utilized to reduce the wear of tooling (and hence recurring cost of tools, drill bits, saws, etc.) in many processes including, for example, stamping, peening, drilling, machining, grinding, polishing, incremental sheet forming, cutting, and punching.

In regard to the shearing of wear agglomerates, the wear agglomerates are formed when wear particles are trapped at the interface and compacted under the large contact pressure (see generally, Oktay, S. T., and Suh, N. P., "Wear particle formation and agglomeration", Journal of Tribology 114, No. 2, (1992) 379-393). Since the wear agglomerate is subjected to the frictional shearing (destabilization) during sliding, lowering the shear strength between compacted particles results in easier breakage of the wear agglomerate. Due to the abundance of oil with dispersed nanoparticles as the lubricating fluid at the interface, nanoparticles adhere to individual wear particles and participate in the wear agglomeration process. The non-limiting examples of nanoparticles described herein, i.e. $MoS_2$, $WS_2$, and hBN, are solid lubricants with very low shear strengths (see generally, Kazuhisa Miyoshi, Solid Lubrication Fundamentals & Applications, CRC; 1st edition (Oct. 15, 2001)). Therefore, the shearing of the wear particles within the agglomerate requires less shear force. SEM micrographs have revealed the existence of $MoS_2$, $WS_2$, and hBN at the sheared interfaces.

Such embodiments are operable for reducing wear between two components in sliding and rolling contact, rather than reducing friction between the components. Using configurations formulated to reduce wear, rather than formulated to reduce friction, experimental tests have shown up to 70 percent reduction in weight loss of the harder material (the tool or die). It should be noted that a configuration for reducing wear may not be the configuration that results in the least amount of friction.

Figure 2:
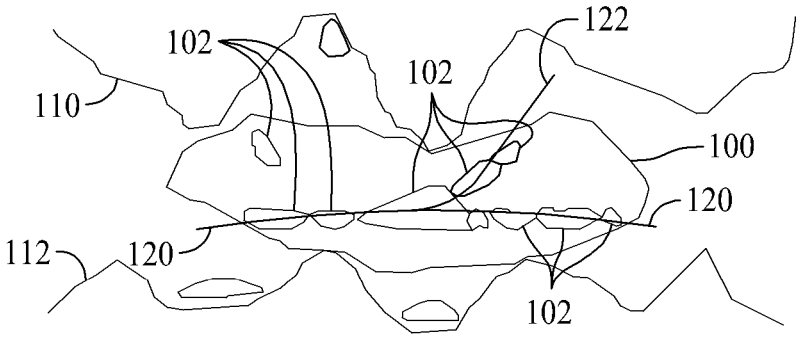
FIG. 2 is a depiction of an agglomerated wear particle that is destabilized through introduction of shear lines therethrough.

FIG. 2 depicts an agglomerated wear particle 100 that is destabilized through introduction of shear lines therethrough. In one embodiment, destabilization of agglomerated wear particle 100 is achieved by introducing specific nanoparticles 102 into the agglomerated wear particle 100. In one practical application, the nanoparticles 102 are introduced via a lubricating fluid. Other embodiments include introducing the nanoparticles 102 via a dry powder or via a coating on one or more of the parts. Another embodiment contemplates introducing the nanoparticles 102 into the agglomerated wear article 100 as a constituent of one of the two materials that are in sliding contact with one another.

For one embodiment of the present invention, a sonicator was used for dispersing the nanoparticles in the oil samples whose volume was 10 $cm^3$. The sonication was carried out for two periods of five minutes at 10 watts output power while the oil was cooled, via a heat exchanger, with cold water to prevent heating. The concentration of nanoparticles by weight fraction in the oil was varied from a fraction of a percentage to several percentages to study the effect of nanoparticle concentration on friction and wear. The sonication process improved the dispersion quality and reduced the average particle size in the oil compared with simple shaking of oil and nanoparticle solutions. Table 1 shows the dispersion characteristic of nanoparticle in the oil.

TABLE 1

Nanoparticles and their dispersion characteristics

| Materials | Average size (nm) as powder | Average size (nm) in oil after shaking | Average size (nm) in oil after sonication |
|---|---|---|---|
| $MoS_2$ nanoparticles | 70-100 | 1000 | 600 |
| $WS_2$ nanoparticles | 50 | 600 | 450 |
| hBN nanoparticles | 70 | 800 | 550 |

A preliminary result of the introduction of nanoparticles 102 is illustrated by FIG. 2. Both the hard surface 110 and the soft surface 112 have lost material therefrom. The lost materials have agglomerated with continued action between surfaces 110 and 112 to generate an agglomerated wear particle 100 through continued sliding contact with one another as described above. However, due to the introduction of the nanoparticles 102 into the area of sliding contact, the wear particle 100 now includes a number of nanoparticles 102 embedded within wear particle 100 which results in shear lines 120 and 122 that extend through the wear particle 100. In certain alternative applications, the nanoparticles 102 are fabricated from one or more solid lubricants, including, but not limited to, molybdenum disulfide ($MoS_2$), tungsten disulfide ($WS_2$), and hexagonal boron nitride (hBN), and other solid lubricants such as graphite and others known in the art.

The agglomerated wear particle 10 (shown in FIG. 1) consists completely of materials that have worn off of surfaces 12 and 14 and have clustered together into essentially a single particle. One result is that the wear particle acts like a solid mass, as there are no shear lines therethrough. Another result is that wear particle 10 operates on both surfaces 12 and 14, rather than surface 12 operating directly on surface 14.

Figure 3:
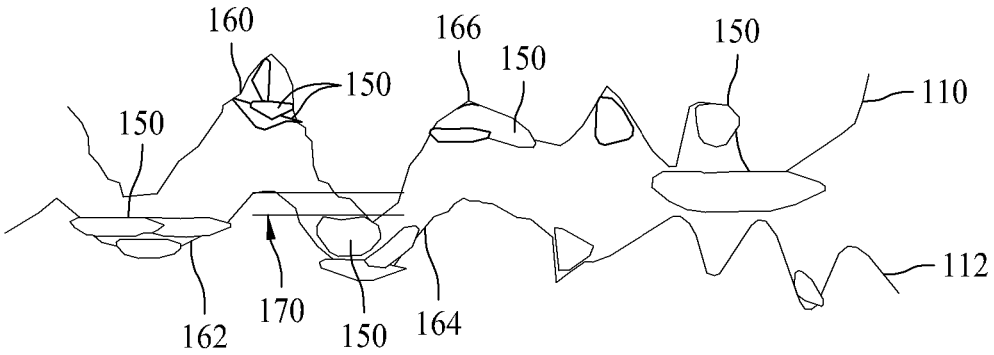
FIG. 3 illustrates the agglomerated wear particle of FIG. 2 broken up into multiple, smaller wear particles.

Wear particle 100 is in contrast because wear particle 100 builds up from the wearing of surfaces 110 and 112, and the clustering of particles therefrom, along with some number of the nanoparticles 102. The presence of the nanoparticles 102 and the resulting shear planes 120 and 122 operate to prevent wear particle 100 from attaining a size similar to that of wear particle 10. More specifically, in the presence of a sufficient pressure against wear particle 100, it will break down into multiple, smaller pieces as shown in FIG. 3. As mentioned above, the higher percentage of time such particles spend in the non-agglomerated state reduces the amount of wear between the two surfaces in sliding contact with one another.

FIG. 3 illustrates that the agglomerated wear particle 100 of FIG. 2 has broken up into multiple, smaller wear particles 150. These smaller wear particles 150 tend to migrate into the valleys 160, 162, 164, and 166, for example, associated with surfaces 110 and 112 thereby reducing the wear on surfaces 110 and 112 associated with wear particle 100 and the like. Two results of the breaking down of agglomerated wear particle 100 are that machining into the soft materials is cleaner, and the cutting device associated with the hard surface 110 lasts longer both of which are illustrated by the lines of cutting area 170.

By adding nanoparticles at a certain percentage by weight, generally to a lubricant associated with that process, those nanoparticles cluster with materials removed from the surfaces to form the agglomerated wear particle 100. It should be noted that nanoparticles themselves may be provided in one or more various shapes including, but not limited to, flakes, balls, and rods. The agglomerated wear particle 100 is sometimes referred to as an abrasive wear ball. This abrasive wear ball breaks apart at the shear planes 120, 122, which are caused by the nanoparticles 102 once a force, such as that which may be introduced by the sliding contact associated with a machining process, is applied. The choice of composition and concentration of nanoparticles added, for example to a lubricant, depends in part on the metals, alloys, composite materials and any other materials that may be used in a machining process. The choice of composition and concentration of nanoparticles added may also be affected by a viscosity associated with the lubricant, for example, maintaining a usable working viscosity of the lubricating fluid, both prior to and after addition of the particular nanoparticles. The reduced size of the separate pieces of the agglomerated wear particle 100 reduces wear on both surfaces.

The embodiments described herein relate to the addition of nanoparticles to an existing work area. There are a host of possible nanoparticles, possible lubricants, and non-lubricant approaches that can be brought to bear against any of a host of machining processes. More specifically, the embodiments relate to the destabilization of agglomerated wear particles, as well as the determination of nanoparticle, and weight percentage of that nanoparticle to use, to gain a significant advantage in the machining process.

Figure 4:
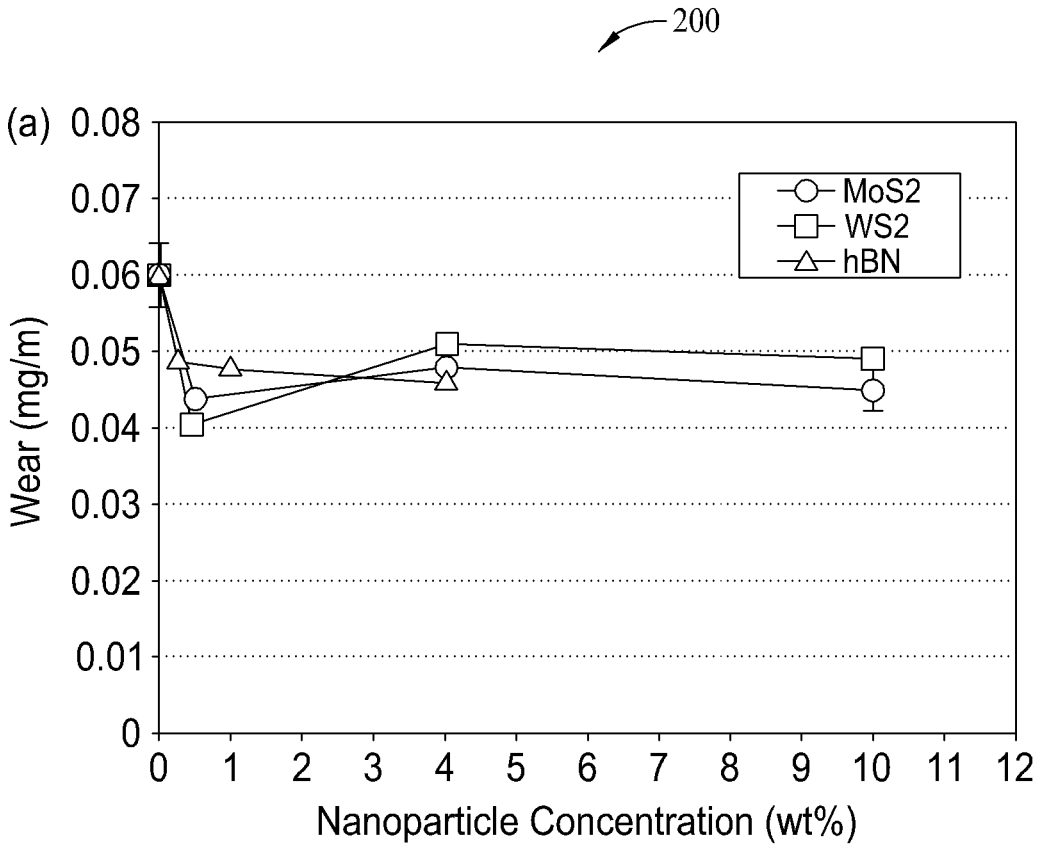
FIG. 4 is a graph that illustrates reduction in wear as a function of nanoparticle concentration of hexagonal boron nitride, molybdenum disulfide, or tungsten disulfide nanoparticles being added to a lubricant in a sliding contact process between two surfaces.

FIG. 4 is an example graph 200 that illustrates the wear reducing results of adding nanoparticles to a machining process that utilizes titanium sheets against 440C steel balls. Graph 200 illustrates the reduction in wear when molybdenum disulfide ($MoS_2$), tungsten disulfide ($WS_2$), or hexagonal boron nitride (hBN), are added to a lubricant in a percentage, by weight from about 0.1 percent to about 10 percent. Graph 200 further illustrates that about 0.5% by weight of tungsten disulfide ($WS_2$) optimizes the reduction in wear. Graph 200 also illustrates that, for the materials utilized (titanium and steel), tungsten disulfide provides a better reduction in wear rate than does either of hexagonal boron nitride (hBn) and molybdenum disulfide ($MoS_2$).

Since more than one nanoparticle choice may work for a given pair of surfaces, such as a metal surface pairing, it should be noted that the choice of nanoparticle can be made based on cost and/or a desire to not "gum up" the lubricant being utilized in the machining process by adding too much nanoparticle powder. In one example, a lubricant will effectively contain between about zero and ten percent by weight of a nanoparticle, with a particle size of about 100 nanometers, or less. This percentage will vary depending upon the surface chemistry of the nanoparticles used, the chemistry of the lubricant, and the operating conditions.

Figure 5:
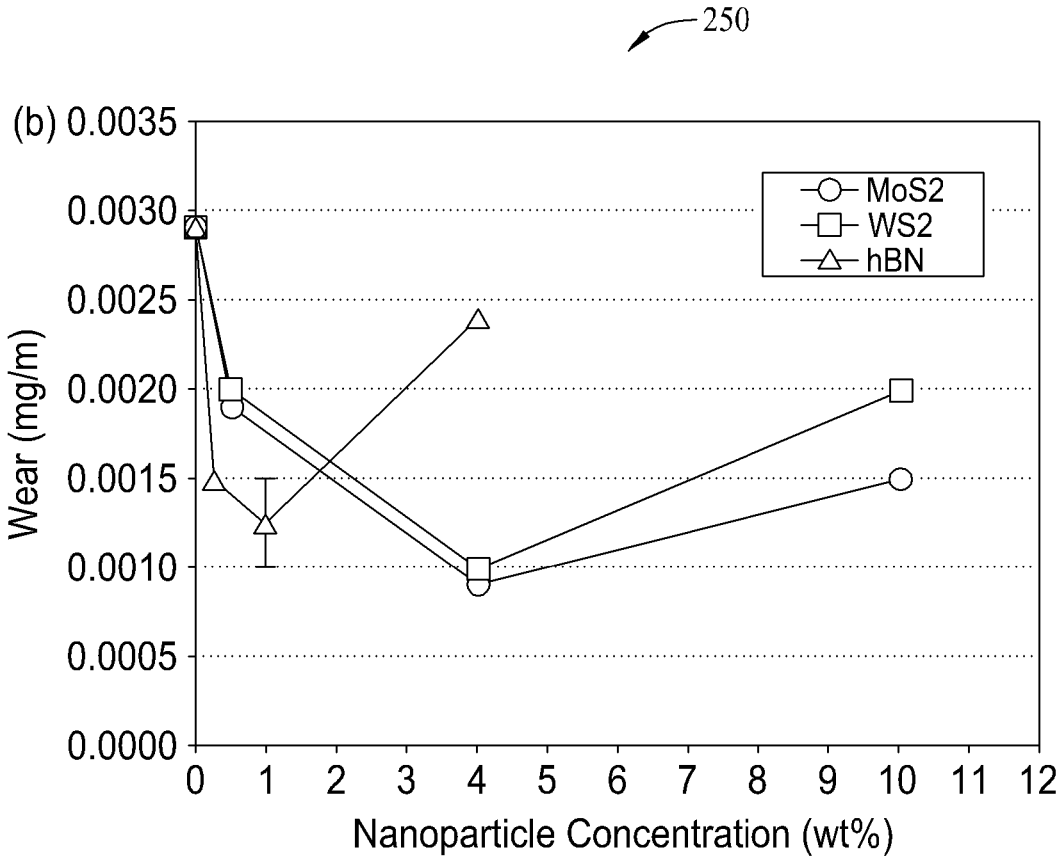
FIG. 5 is a graph that illustrates different rates in the reduction in wear when hexagonal boron nitride, molybdenum disulfide, or tungsten disulfide nanoparticles are added to a lubricant in a sliding contact process between two steel surfaces.

FIG. 5 is a graph 250, illustrating that maximum wear reduction occurs when adding weight 1% of hexagonal boron nitride (hBN), 4% of molybdenum disulfide ($MoS_2$), or 4% of tungsten disulfide ($WS_2$), by weight, to a machining process that includes steel sheets against the 440C steel balls. The hexagonal boron nitride provides dramatic improvements in wear reduction with only a one percent by weight concentration, while slightly better results can be achieved using four times as much $MoS_2$ or $WS_2$. While the optimum wear reduction appears to be at about 1% of hexagonal boron nitride (hBN), about 4% of molybdenum disulfide ($MoS_2$), or about 4% of tungsten disulfide ($WS_2$), by weight, graph 250 illustrates the reduction in wear when molybdenum disulfide ($MoS_2$), tungsten disulfide ($WS_2$), or hexagonal boron nitride (hBN), are added to a lubricant in a percentage, by weight from about 0.1 percent to about 10 percent.

Graph 250 also illustrates a reduction in wear particle production of over 50 percent. A cost component may also be illustrated by the fact that only a one percent concentration of hexagonal boron nitride provides a result that is only slightly reduced from the results associated with a four percent concentration of either $MoS_2$ or $WS_2$.

Figure 6:
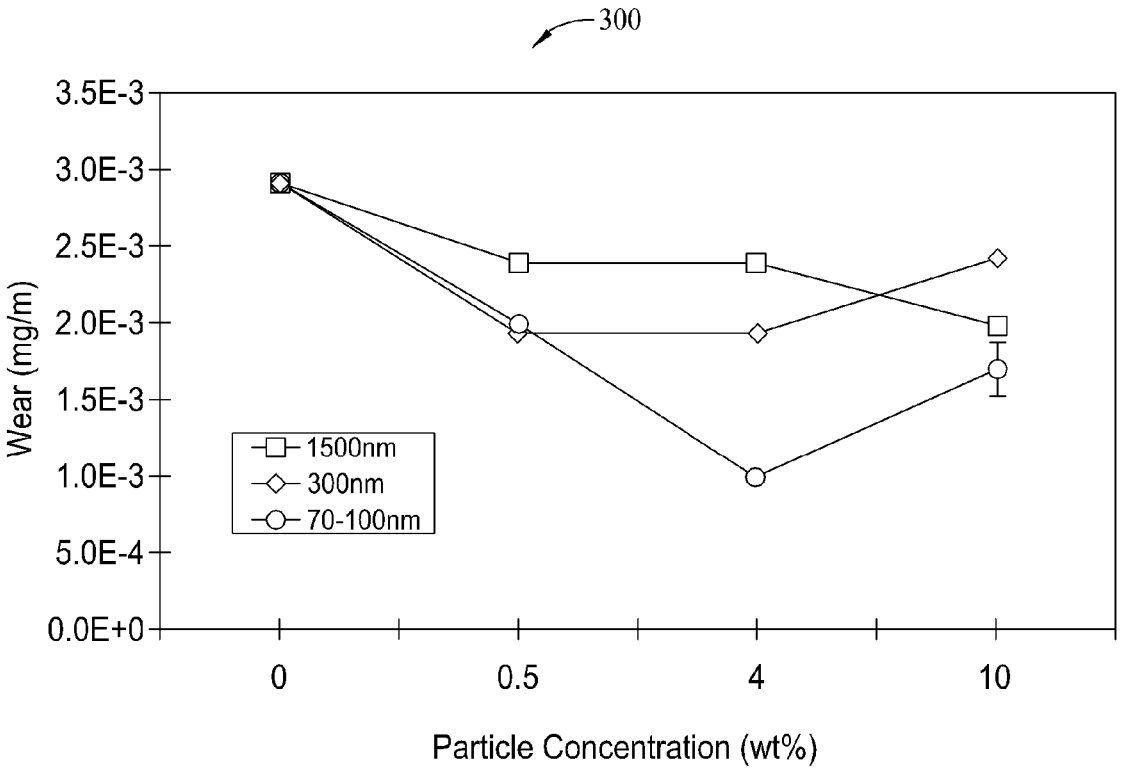
FIG. 6 is a graph that illustrates different rates in the reduction in wear of 440C steel balls when different particle concentrations of hexagonal boron nitride, molybdenum disulfide, or tungsten disulfide nanoparticles are added to a lubricant in a process where the steel balls are sliding against steel sheets.

FIG. 6 is a graph 300 that illustrates different rates in the reduction in wear of 440C steel balls when different particle concentrations of hexagonal boron nitride, molybdenum disulfide, or tungsten disulfide nanoparticles are added to a lubricant in a process where the steel balls are sliding against steel sheets. The wear in the steel balls, in milligrams per meter, is most reduced when a four percent concentration, by weight, of molybdenum disulfide nanoparticles is added to the lubricant. The reductions in wear of the steel balls when utilizing hexagonal boron nitride or tungsten disulfide nanoparticles, in various concentration, with the lubricant is also shown.

Unlike many nanoparticle uses, the processes described here are insensitive to the uniformity of dispersion of the nanoparticles. Once the nanoparticles are engaged with the wear particles formed in the machining process, the force of the process breaks down agglomerations. However, it is important to keep the nanoparticles in suspension as they are being applied to the machining process. The sonication process described above is but one example of suspension, or dispersion, of the nanoparticles within a lubricant.

The above described embodiments are capable of reducing the weight loss of a hard surface, such as a tool or die by up to 70% as compared to existing oils and lubricants. In addition, the embodiments are also effective in reducing the weight loss of the softer surface, the part being tooled, at least as compared to existing oils and lubricants.

This written description uses examples to disclose various embodiments, which include the best mode, to enable any person skilled in the art to practice those embodiments, including making and using any compositions or systems and performing any incorporated methods. For example, the embodiments may include biocompatible applications, for example, artificial joints, insulin pumps, ventricular assist devices, and others as known in the art. In addition, other applications include vacuum-compatible lubrication (e.g., spacecraft and satellites), contaminate-sensitive manufacturing, and non-outgassing applications. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for reducing wear between two surfaces in at least one of sliding or rolling contact with one another, with relative motion between the two surfaces, said method comprising:

introducing nanoparticles between the two surfaces;

contacting the two surfaces for an amount of time that causes agglomerated wear particles to be generated between the two surfaces, wherein the agglomerated wear particles include materials from the two surfaces and the nanoparticle material embedded within the agglomerated wear particles, the nanoparticles introduced in an amount and having a composition that results in shear lines being generated within the agglomerated wear particles;

matching the nanoparticle composition with the materials from which the two surfaces are fabricated to produce a sufficient number of shear lines that extend through the embedded nanoparticles and through the agglomerated wear particles to induce disassembly of the agglomerated wear particles under load; and subjecting the agglomerated wear particles to at least one load, using at least one of the two surfaces, such that the agglomerated wear particles disassemble along the shear lines into multiple smaller wear particles, and such that surfaces, defined on opposing sides of the shear lines, of the nanoparticles are exposed when the agglomerated wear particles disassemble along the shear lines.

2. The method according to claim 1 wherein introducing nanoparticles comprises at least one of:

introducing nanoparticles between the two surfaces via a lubricating fluid;

introducing nanoparticles between the two surfaces via a dry powder;

introducing nanoparticles between the two surfaces via a coating on one or more of the two surfaces; and introducing nanoparticles between the two surfaces as a constituent of one of the two surfaces in sliding contact.

3. The method according to claim 1 wherein introducing nanoparticles between the two surfaces comprises introducing at least one of hexagonal boron nitride (hBN), molybdenum disulfide ($MoS_2$), and tungsten disulfide ($WS_2$) to a machining process.

4. The method according to claim 1 wherein introducing nanoparticles between the two surfaces comprises introducing between about 0.1 percent and about ten percent by weight of hexagonal boron nitride (hBN) to lubricating fluid utilized between two steel surfaces in sliding contact with one another.

5. The method according to claim 1 wherein introducing nanoparticles between the two surfaces comprises introducing between about 0.1 percent and about ten percent by weight of one of molybdenum disulfide ($MoS_2$) and tungsten disulfide ($WS_2$) to lubricating fluid utilized between a titanium surface and a steel surface in sliding contact with one another.

6. The method according to claim 1 wherein introducing nanoparticles between the two surfaces comprises embedding nanoparticles within at least one agglomerated wear particle.

7. The method according to claim 1 wherein introducing nanoparticles between the two surfaces comprises adding a specific nanoparticle, by weight percentage, to at least one of a lubricant and a machining fluid that is to be placed between the two surfaces.

8. The method according to claim 1 further comprising selecting a nanoparticle composition to reduce wear between the two surfaces, using a comparison of the costs of specific nanoparticles against an amount of wear reduction provided by the specific nanoparticles.

9. The method according to claim 1 further comprising selecting a nanoparticle composition to reduce wear between the two surfaces based on maintaining a usable working viscosity of a lubricating fluid utilized to introduce the nanoparticles to the area between the two surfaces.

10. The method according to claim 1 wherein introducing nanoparticles comprises dispersing nanoparticles within a lubricant using a sonication process.

11. A method for reducing wear of two surfaces in sliding contact with one another, said method comprising:

dispersing nanoparticles in a lubricating fluid using a sonication process that reduces an average particle size in the lubricating fluid;

contacting the two surfaces for an amount of time that causes agglomerated wear particles to be generated between the two surfaces, wherein the agglomerated wear particles include materials from the two surfaces and the nanoparticles embedded within the agglomerated wear particles;

destabilizing, using the nanoparticles dispersed in the lubricating fluid, the agglomerated wear particles, wherein the nanoparticles are introduced between the two surfaces in a composition such that shear lines are generated within the agglomerated wear particles, and such that the shear lines extend through the embedded nanoparticles and through the agglomerated wear particles; and causing the destabilized, agglomerated wear particles to break down into smaller pieces along the shear lines into multiple, smaller wear particles by applying a pressure to the agglomerated wear particles, such that surfaces, defined on opposing sides of the shear lines, of the nanoparticles are exposed when the agglomerated wear particles disassemble along the shear lines.

12. The method according to claim 11 wherein destabilizing, using the nanoparticles dispersed in the lubricating fluid, wear particles that agglomerate between the two surfaces comprises introducing at least one of hexagonal boron nitride (hBN), molybdenum disulfide ($MoS_2$), and tungsten disulfide ($WS_2$) to a machining process.

13. The method according to claim 11 wherein destabilizing, using nanoparticles, wear particles that agglomerate between the two surfaces comprises embedding nanoparticles within agglomerated wear particles.

14. The method according to claim 11 wherein destabilizing, using nanoparticles, wear particles that agglomerate between the two surfaces comprises adding a specific nanoparticle, by weight percentage, to at least one of a lubricant and a machining fluid that is to be placed between the two surfaces.

15. The method according to claim 11 further comprising matching a nanoparticle composition with the materials from which the two surfaces are fabricated to produce a sufficient number of shear lines within the agglomerated wear particles to induce disassembly of the particles under load.

* * * * *